US008376924B2

(12) United States Patent
Burford et al.

(10) Patent No.: US 8,376,924 B2
(45) Date of Patent: Feb. 19, 2013

(54) SAFETY VALVE FOR A CENTRIFUGAL SEPARATOR

(75) Inventors: Nigel Burford, Taunton (GB); Klemens Dworatzek, Edingen (DE); Anthony W. Fell, Yeovil (GB); John Lawrence Mills, Ilminster (GB); Nicholas Foulkes, Chard (GB)

(73) Assignee: Mann + Hummel GmbH, Ludwigsburg (DE)

( * ) Notice: Subject to any disclaimer, the term of this patent is extended or adjusted under 35 U.S.C. 154(b) by 0 days.

(21) Appl. No.: 13/193,821

(22) Filed: Jul. 29, 2011

(65) Prior Publication Data

US 2011/0281715 A1 Nov. 17, 2011

Related U.S. Application Data

(63) Continuation of application No. PCT/EP2010/051007, filed on Jan. 28, 2010.

(51) Int. Cl.
*B04B 9/06* (2006.01)

(52) U.S. Cl. ..... 494/49

(58) Field of Classification Search ..... 494/24, 494/36, 43, 49, 64, 65, 31–34, 67, 83, 84, 494/901, 5, 60; 210/171, 232, 360.1, 380.1, 210/416.5; 184/6.24
See application file for complete search history.

(56) References Cited

U.S. PATENT DOCUMENTS

| | | | | |
|---|---|---|---|---|
| 4,106,689 | A * | 8/1978 | Kozulla | 494/5 |
| 4,165,032 | A * | 8/1979 | Klingenberg | 494/49 |
| 4,221,323 | A * | 9/1980 | Courtot | 494/10 |
| 4,498,898 | A | 2/1985 | Haggett | |
| 4,557,831 | A | 12/1985 | Lindsay et al. | |
| 6,974,408 | B2 * | 12/2005 | Grosse-Wiesmann | 494/5 |
| 2005/0020428 | A1 * | 1/2005 | Grosse-Wiesmann | 494/49 |
| 2006/0229185 | A1 * | 10/2006 | Herman | 494/49 |
| 2008/0220957 | A1 * | 9/2008 | Herman | 494/5 |
| 2011/0281715 | A1 * | 11/2011 | Burford et al. | 494/49 |

FOREIGN PATENT DOCUMENTS

| | | | |
|---|---|---|---|
| DE | 10329199 | A1 | 1/2005 |
| GB | 2160796 | A | 1/1986 |
| GB | 2296942 | A | 7/1996 |
| GB | 2467330 | A * | 8/2010 |
| SU | 1097378 | A * | 6/1984 |

OTHER PUBLICATIONS

PCT search report PCT/EP2010/051007, GB search report GB0901462.2.

* cited by examiner

*Primary Examiner* — Charles E Cooley
(74) *Attorney, Agent, or Firm* — James Hasselbeck

(57) ABSTRACT

A shuttle valve (30) is provided in the axial bore (19) of a stationary spindle (11) through which fluid is supplied to a rotor (12) of a centrifugal separator to close off the fluid outlets (23, 24) to the rotor (12) automatically upon removal of the cap (27) or cover assembly (20) in the event that fluid supply has not been switched off.

6 Claims, 2 Drawing Sheets

SAFETY VALVE FOR A CENTRIFUGAL SEPARATOR

CROSS REFERENCE TO RELATED APPLICATIONS

This application is a bypass continuation application of international application No. PCT/EP2010/051007 having an international filing date of Jan. 28, 2010 and designating the United States, the International Application claiming a priority date of Jan. 29, 2009, based on prior filed United Kingdom patent application No. GB 0901462.2, the entire contents of the aforesaid international application and the aforesaid United Kingdom patent application being incorporated herein by reference.

TECHNICAL FIELD

The invention relates to a self-powered centrifugal separator equipped with a safety valve operable to assure shutoff of fluid flow during servicing.

BACKGROUND OF THE INVENTION

Self-powered centrifugal separators are well known for separating fluids of different densities or for separating particulate matter from liquids and have long been used in lubrication systems for engines, particularly diesel-powered vehicle engines, as well as in other industrial separation processes.

The principle of operation of such a centrifugal separator is that a housing contains a rotor which is supported therein to spin at high speed about a substantially vertical axis. Fluid from which contaminants are to be removed is supplied to the rotor at elevated pressure along the axis of rotation and is ejected from tangentially directed nozzles into the housing from which it drains to a sump. Thus, the fluid from which contaminants are to be removed also provides the drive for the rotor. As this fluid passes through the rotor, denser contaminant materials or particles are separated therefrom centrifugally and retained in the rotor, typically as a cake adhering to the interior surface of the rotor, which is cleaned or replaced at intervals.

GB 2160796 and GB 2296942 disclose self-powered centrifugal separators of the type which comprises a base, a substantially vertical spindle upstanding from the base, a rotor mounted on the spindle for rotation thereabout by reaction to fluid emission from rotor nozzles, the base having an inlet passage for said fluid and the spindle having an axial bore and outlets therefrom to supply fluid to the rotor from said inlet passage, and a cover mounted on the base and enclosing the rotor. In this type of separator the fluid is supplied at pressure from the base of the housing and flows upwards through the axial bore to outlets near the top of the bore, which is typically a blind bore. A releasable cap is typically mounted at the top of the spindle to secure the cover. Other designs of self-powered centrifugal separators, for example as disclosed in U.S. Pat. No. 4,498,898 and U.S. Pat. No. 4,557,831, have fluid supplied downwards into the top of the axial bore of the spindle.

In respect of such separators used in lubrication systems for engines it is already known to provide a spring biased valve in the inlet flow path of the fluid to shut off flow at low pressure. This is shown in the applicant's earlier EP 1 009 535 where such a valve is provided in an inlet flow passage in the base of the housing at a location prior to flow of fluid upwards into the axis of the rotor. This protects the engine by ensuring maximum supply of lubricating fluid to said engine when the pressure is low by not diverting fluid to the centrifugal cleaning means at such time.

SUMMARY OF THE INVENTION

An object of the present invention is to provide a safety feature for a self-powered centrifugal separator of the type just referred to ensure that supply of fluid to the rotor is shut off whenever the separator is being accessed for maintenance or repair.

With this object in view, the present invention provides a centrifugal separator of the type referred to characterized by provision of a cap which serves releaseably to close the top of the axial bore in the spindle and by provision of a shuttle valve is provided in the axial bore, said valve, upon release of the cap from the top of the axial bore, being displaceable, under pressure of fluid supplied from the base of the housing, to close off the top of the axial bore and to close off outlets from the bore to the rotor.

Thus, the shuttle valve automatically closes off the openings whereby fluid, typically oil, flows into the rotor or leaks from the top of the spindle whenever the cover is removed without the circulation pump for supply of oil (or other fluid) to the separator having first been switched off or isolated. Generally, personnel employed to maintain and clean such separators are trained in procedure to switch off the fluid pump before removing the cover of the centrifugal separator. However, there is always a risk of a procedural error, possibly more likely in an industrial, manufacturing environment, where personnel may not be as well trained specifically in relation to centrifugal separators, than in a vehicle maintenance environment. Accordingly, such a safety valve serves as a useful failsafe, preventing leaks which are messy, wasteful and potentially hazardous.

In preferred embodiments of the invention the shuttle valve includes a valve body and a spacer portion, the spacer portion being acted upon by the cover to locate the valve body within the axial bore. Thus, the spacer portion advantageously provides for correct location of the valve body, relative to the cover, in the axial bore of the spindle during normal operation of the separator and particularly for correct repositioning of same after release and subsequent replacement of the cover. In this respect the valve body will include openings or recesses to be aligned with or allow fluid access to the spindle outlets to the rotor during normal operation of the separator as well as means to close off said outlets upon release of the cover.

The spacer portion or the valve body will include means to close off the top of the axial bore upon removal of the cover.

It is also advantageous for the spacer portion to be configured to project from the top of the axial bore upon release of the cover and displacement of the valve under fluid pressure. The appearance of such a projecting spacer portion then serves to indicate to the person removing the cover that the fluid pump has not been switched off.

In preferred embodiments the cap which serves to close the top of the spindle bore is the same cap which conventionally attaches the cover to the spindle to secure it against the base. However, in other embodiments of separator the closure cap could be provided separately from means to attach the cover.

BRIEF DESCRIPTION OF THE DRAWINGS

The accompanying Figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Features of the present invention, which are believed to be novel, are set forth in the drawings and more particularly in the appended claims. The invention, together with the further objects and advantages thereof, may be best understood with reference to the following description, taken in conjunction with the accompanying drawings. The drawings show a form of the invention that is presently preferred; however, the invention is not limited to the precise arrangement shown in the drawings.

Figure 1:
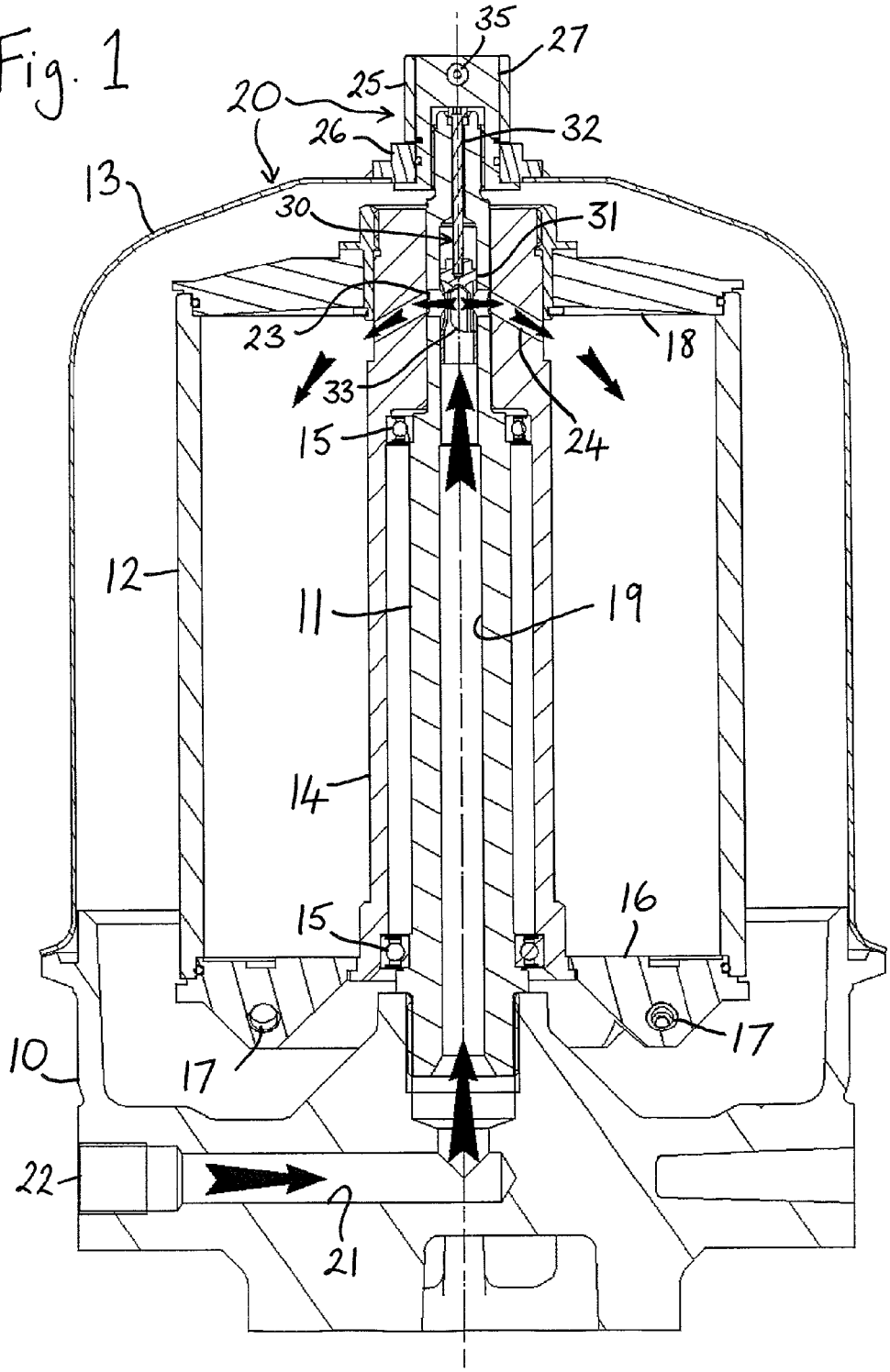
FIG. 1 is a schematic longitudinal sectional view of the centrifugal separator during normal operation.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of apparatus components related to a centrifugal separator equipped with a safety shutoff valve. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As shown, this exemplary embodiment has the typical features of a self-powered centrifugal separator, namely a base 10, a stationery spindle 11 upstanding from the base 10 to provide a substantially vertical axis upon which a rotor 12 is mounted and a cover assembly 20 secured against the base and enclosing the rotor 12. The rotor 12 includes a bearing sleeve 14 which is rotatably mounted upon the spindle 11 by way of bearings 15, a bottom plate 16 provided with tangentially directed nozzles 17, a top plate 18 and cylindrical walling. The spindle 11 has a central bore 19 extending through from its lower end to its upper end, which upper end extends beyond the rotor 12. Both the external diameter of the spindle 11 and the internal diameter of the spindle 11 (ie, the diameter of the bore 19) decrease stepwise at spaced locations between the lower and upper ends thereof, as is evident in the drawings.

As shown in FIG. 1, the cover assembly, designated generally by reference 20, includes a bell shaped cover 13, a ring 26 welded thereto around an axial opening and a rotatable internally threaded cap 27, which is retained by the ring 26, and serves to threadedly engage the upper end of the spindle 11. The cover assembly 20 also includes an outer tube 25 which fits over the cap 27 and a transverse pin 35 which extends through the cap 27 and the tube 25 to facilitate manual rotation of same. Engagement of the cap 27 with the upper end of the spindle 11 both secures the cover assembly 20 in position and closes off the bore 19.

A fluid passageway 21 extends through the base 10 from an inlet port 22 to supply fluid upwardly to the bore 19 of the spindle 11 in use of the separator, as shown by the arrows in FIG. 1. At a location just below the top plate 18 of the rotor 12, the spindle 11 and the bearing sleeve 14 have aligned openings, 23, 24 communicating to the interior of the rotor 12 for supply of the fluid thereto. The pressure of the fluid and its tangential emission via the nozzles 17 drives the rotor 12 and by centrifugal force separates particulate matter which adheres to the interior surface of the rotor 12. The fluid from which particulates have been separated drains from the base 10 to a sump (not shown) and may be re-circulated to the inlet port 22.

Figure 2:
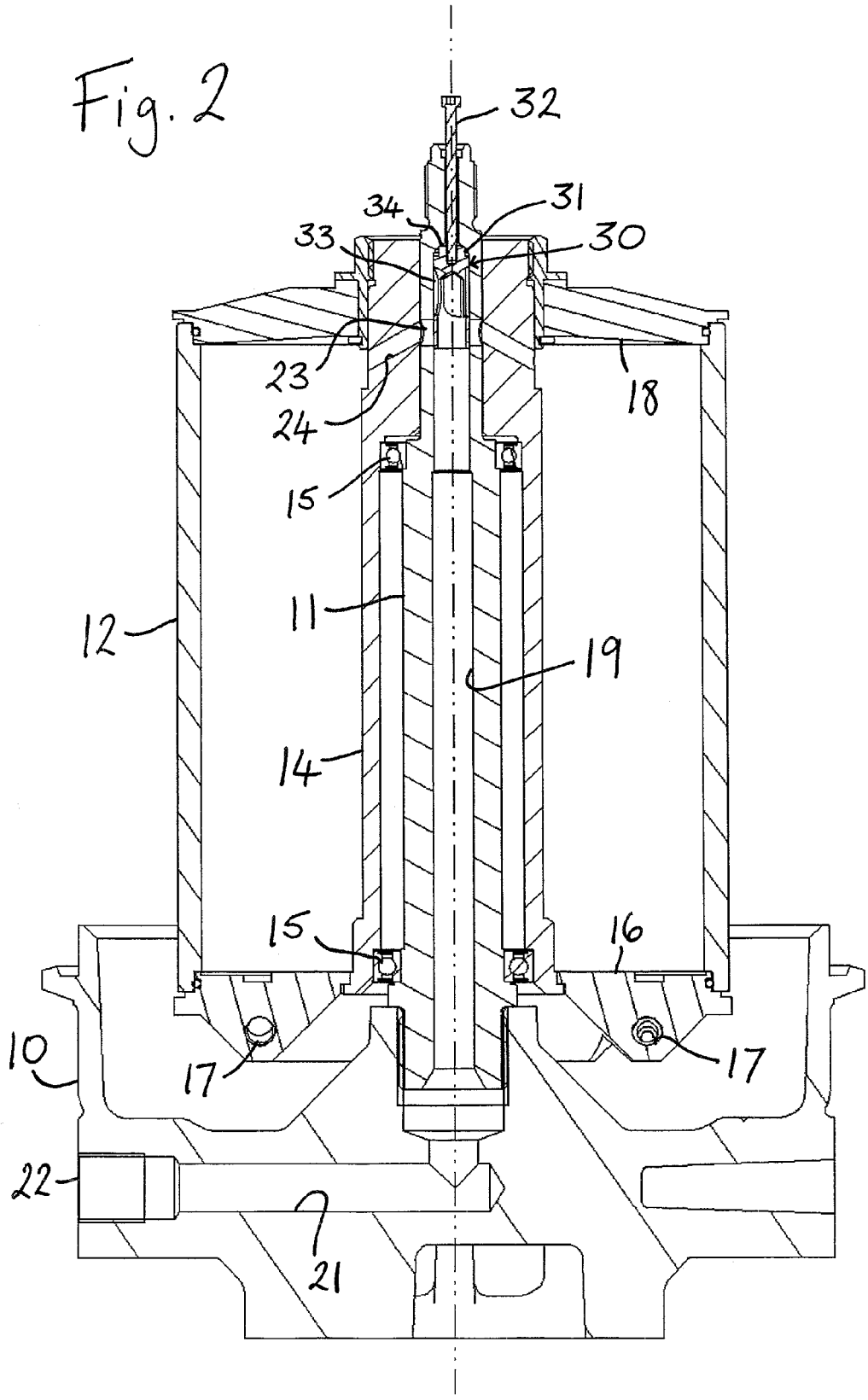
FIG. 2 is a similar view of the separator when the cover and housing have been removed.

At intervals it is necessary to remove the rotor 12 for cleaning out or replacement. This is done by removal of the cover assembly 20 to access the rotor 12, as shown in FIG. 2. The rotor 12 can then be removed from the spindle 11. The cover assembly 20 in this embodiment is released by unscrewing the threaded cap 27 from the upper end of the spindle 11. The entire assembly 20, including the cover 13, can then be lifted off and the upper end of the spindle bore 19 is opened at the same time as the cap 27 is removed.

A shuttle valve 30 is provided in the spindle bore 19 to close off the openings 23, 24 automatically, under pressure of fluid travelling up the bore 19, as soon as the cover assembly 20 is removed. The valve 30 also closes off the upper end of the bore 19 so that leakage of fluid from the spindle 11 is prevented.

Usually a fluid pump supplying fluid under pressure to the inlet 22 of the separator will be switched off or isolated before removal of the cover assembly 20 in accordance with usual maintenance procedure. However, if there is any oversight and the fluid supply is not switched off the shuttle valve 30 provides a failsafe.

As shown, the shuttle valve 30 comprises a valve body 31 and a spacer portion in the form of a bolt 32 which extends upwards from the body 31 in the spindle bore 19. In normal use, as in FIG. 1, the top of the bolt 32 is in contact with the underside of the threaded cap 27 of the fitted cover assembly 20. The valve body 31 is thereby held at the correct position therebelow in the bore 19, adjacent the openings 23, 24. In this respect the valve body 31 is hollow and is formed with slots 33 which at this position (FIG. 1) align with the openings 23, 24 to allow fluid to flow into the rotor 12.

If the cover assembly 20 is removed when fluid is still being supplied at pressure to the separator, the pressure of fluid pushes the valve body 31 upwards so that its trailing region blocks off the openings 23 in the spindle, as shown in FIG. 2. The bolt 32 at the same time projects out of the top of the spindle bore 19, visually indicating that the shuttle valve failsafe has operated to close off fluid to the rotor 12. Also, in this position the top of the valve body 31 contacts a shoulder 34 in the spindle bore 19 to prevent direct leakage of fluid from the top of the spindle 11.

Whether or not the fluid supply is switched off in the meanwhile, after any maintenance or replacement of the rotor 12, the cover assembly 20 can be replaced and re-secured by means of the threaded cap 27. As the cap 27 is re-secured to the top of the spindle 11 it acts to push down the bolt 32 which causes the valve body 31 attached therebelow to resume its operational position as in FIG. 1, where the slots 33 are in alignment with the openings 23 and 24.

The invention is not restricted to the details of the foregoing embodiment and variations in design are possible within the scope of the appended claims. For example, the spacer portion, exemplified by the bolt, need not project from the top of the spindle when the cover assembly is removed. Instead the cap may have a portion which will project down into the spindle base to contact and reposition the shuttle valve. In other embodiments instead of an integrated cover assembly, the cover enclosing the rotor may be provided separately from the closure cap which closes off the spindle bore. There may also be other variations in design detail.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims The invention is defined solely by the appended claims including any amendments made during the pendency of this application and all equivalents of those claims as issued.

The invention claimed is:

1. A self-powered centrifugal separator comprising:

a base having a fluid inlet passage;

a substantially vertical elongated spindle including a bore extending axially between opposing ends of said spindle; and at least one fluid outlet opening extending through a wall of said spindle from within said axial bore to an exterior of said spindle into an interior of said centrifugal separator;

wherein said spindle is mounted to said base at a first end of said spindle, said spindle upstanding from said base, said axial bore at said first end of said spindle in fluid flow communication with said fluid inlet passage;

a rotor removeably mounted on said spindle for rotation thereabout;

at least one tangentially directed fluid flow nozzle arranged on said rotor;

wherein said rotor is urged to rotate about said spindle by reaction forces generated by fluid flow emission of fluid from an interior chamber of said rotor through said rotor nozzles to an exterior of said rotor, wherein said base inlet passage delivers said fluid to said axial bore at said first end of said spindle to flow through said axial bore to said outlet openings of said spindle supplying fluid to said interior chamber of the rotor from said inlet passage, and a cover removably mounted onto said base, said cover together with said base enclosing the rotor;

a cap removably secured onto an opposing second end of said spindle, said cap closing over said axial bore at said second end of said spindle, a shuttle valve arranged within said axial bore of said spindle, said shuttle valve operable by pressure of said fluid in said axial bore from said inlet passage to pushably displace said shuttle valve between an operating position in which said at least one outlet opening is open to said axial bore permitting fluid flow from said axial bore into said interior chamber of said rotor; and a closed position in which said shuttle valve blocks off and closes said at least one outlet opening preventing fluid flow from said axial bore into said interior chamber of said rotor;

wherein said cap, when removably secured to said second end of said spindle, said cap blocking said shuttle valve from moving to said closed position, wherein upon release of said cap from said second end of said spindle, said shuttle valve is pushably displaced to said closed position under fluid pressure to close off said axial bore at the second end of the spindle and to close off said at least one outlet opening preventing fluid flow from the axial bore into said rotor as well as preventing fluid flow from said spindle second end, wherein the cap is arranged on an exterior of said cover, wherein the spindle second end extends through an aperture in said cover from an interior of said centrifugal separator to an exterior of said cover, wherein said cap removably secures said cover to said spindle.

2. The self-powered centrifugal separator according to claim 1 wherein the shuttle valve comprises a valve body and a spacer portion, wherein the spacer portion is acted upon by the cap blocking said valve body from moving to said closed position within said axial bore.

3. The self-powered centrifugal separator according to claim 2 wherein said spacer portion is displaced by fluid pressure, said spacer portion projecting outwardly from the top of the axial bore at said second end of said spindle upon release of the cap and displacement of said valve under fluid pressure.

4. The self-powered centrifugal separator according to claim 1 wherein said cap is attached to said cover as part of an integrated cover assembly.

5. The self-powered centrifugal separator according to claim 1 wherein said removably secured cap is threadably secured to said spindle second end.

6. The self-powered centrifugal separator according to claim 1 wherein said valve body has a hollow interior open at a first end to fluid in said axial bore, wherein said valve body is provided with slots arranged on an exterior of said valve body, said slots open to fluid flow from said hollow interior of said valve body, wherein said slots align with said at least one outlet opening when said valve body is in said operating position.

* * * * *